US010769989B2

(12) United States Patent
Chen

(10) Patent No.: US 10,769,989 B2
(45) Date of Patent: Sep. 8, 2020

(54) METHOD AND DEVICE FOR DETECTING THRESHOLD VOLTAGE OF DRIVING TRANSISTOR BY ADJUSTING AT LEAST ONE OF DATA SIGNAL AND REFERENCE SIGNAL LOADED ON TARGET DRIVING TRANSISTOR SUCH THAT A FIRST-ELECTRODE TARGET VOLTAGE OF THE TARGET DRIVING TRANSISTOR IS WITHIN A PRESET VOLTAGE RANGE

(71) Applicant: BOE TECHNOLOGY GROUP CO., LTD., Beijing (CN)

(72) Inventor: Yi Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 49 days.

(21) Appl. No.: 15/977,183

(22) Filed: May 11, 2018

(65) Prior Publication Data

US 2019/0066578 A1 Feb. 28, 2019

(30) Foreign Application Priority Data

Aug. 24, 2017 (CN) ..... 2017 1 0737635

(51) Int. Cl.
*G09G 3/3225* (2016.01)
*G09G 3/3291* (2016.01)
(Continued)

(52) U.S. Cl.
CPC ..... *G09G 3/3225* (2013.01); *G09G 3/006* (2013.01); *G09G 3/3233* (2013.01);
(Continued)

(58) Field of Classification Search
CPC ..... G09G 3/006; G09G 3/30; G09G 3/32; G09G 3/3208; G09G 3/3225;
(Continued)

(56) References Cited

U.S. PATENT DOCUMENTS

2008/0001855 A1* 1/2008 Hamer ..... G09G 3/3233 345/76
2015/0145845 A1* 5/2015 Nam ..... G09G 3/3233 345/209
(Continued)

FOREIGN PATENT DOCUMENTS

CN 104700772 A 6/2015

*Primary Examiner* — Keith L Crawley
(74) *Attorney, Agent, or Firm* — Collard & Roe, P.C.

(57) ABSTRACT

A detecting method and device for detecting threshold voltages of driving transistors. The detecting method includes: loading data signals and reference signals on respective driving transistors in a detection group; when the respective driving transistors are in a turn-off state, detecting first-electrode voltages of the respective driving transistors; and determining a target adjustment set in the detection group according to the first-electrode voltages of the respective driving transistors and a preset voltage range. For each target driving transistor in the target adjustment set, the detecting method further includes: adjusting at least one of a data signal and a reference signal loaded on the target driving transistor; when the target driving transistor is in the turn-off state, detecting a first-electrode target voltage of the target driving transistor; and determining a threshold voltage of the target driving transistor according to the first-electrode target voltage of the target driving transistor.

20 Claims, 6 Drawing Sheets

(51) Int. Cl.
*G09G 3/00* (2006.01)
*G09G 3/3233* (2016.01)

(52) U.S. Cl.
CPC ..... *G09G 3/3291* (2013.01); *G09G 2300/043* (2013.01); *G09G 2300/0819* (2013.01); *G09G 2320/029* (2013.01); *G09G 2320/0233* (2013.01); *G09G 2320/045* (2013.01)

(58) Field of Classification Search
CPC .. G09G 3/3233; G09G 3/3258; G09G 3/3291; G09G 2300/043; G09G 2300/0819; G09G 2300/0876; G09G 2320/0233; G09G 2320/029; G09G 2320/0295; G09G 2320/043; G09G 2320/045
See application file for complete search history.

(56) References Cited

U.S. PATENT DOCUMENTS

| | | | | |
|---|---|---|---|---|
| 2015/0154908 | A1 | 6/2015 | Nam et al. | |
| 2015/0187278 | A1* | 7/2015 | Park | G09G 3/3291 345/212 |
| 2016/0189623 | A1* | 6/2016 | Miwa | G09G 3/3233 345/212 |
| 2016/0189629 | A1* | 6/2016 | Jin | G09G 3/3233 345/211 |
| 2016/0351096 | A1* | 12/2016 | Tani | G09G 3/3233 |
| 2018/0053462 | A1* | 2/2018 | Bae | G09G 3/2074 |
| 2018/0096649 | A1* | 4/2018 | Lee | G09G 3/3233 |
| 2018/0174517 | A1* | 6/2018 | Lee | G09G 3/3233 |

* cited by examiner

METHOD AND DEVICE FOR DETECTING THRESHOLD VOLTAGE OF DRIVING TRANSISTOR BY ADJUSTING AT LEAST ONE OF DATA SIGNAL AND REFERENCE SIGNAL LOADED ON TARGET DRIVING TRANSISTOR SUCH THAT A FIRST-ELECTRODE TARGET VOLTAGE OF THE TARGET DRIVING TRANSISTOR IS WITHIN A PRESET VOLTAGE RANGE

The present application claims priority to Chinese patent application No. 201710737635.3, filed Aug. 24, 2017, the entire disclosure of which is incorporated herein by reference as part of the present application.

TECHNICAL FIELD

Embodiments of the present disclosure relate to a detecting method for detecting threshold voltages of driving transistors and a detecting device thereof.

BACKGROUND

A display panel includes a plurality of pixels arranged in an array, each pixel is provided with a light-emitting diode (such as, an organic light-emitting diode (OLED)) and a driving transistor for driving the light-emitting diode to emit light. A magnitude of a driving current for driving the light-emitting diode is related to a threshold voltage of the driving transistor. In order to avoid an influence of the threshold voltage drift of the driving transistor on display brightness, the threshold voltage of the driving transistor needs to be detected, so as to compensate a data signal according to the threshold voltage during a driving process.

Currently, detecting the threshold voltage of the driving transistor may comprise: connecting a source electrode of the driving transistor to an analog-to-digital converter (ADC); applying a data signal to a gate electrode of the driving transistor, applying a reference signal to the source electrode of the driving transistor, and applying a power signal to a drain electrode of the driving transistor, so as to turn on the driving transistor and output a current to the analog-to-digital converter; and when the driving transistor is in a turn-off state and stops to output the current, determining a threshold voltage of the driving transistor according to a gate voltage Vg (that is, a voltage of the data signal) of the driving transistor and a source voltage Vs detected by the analog-to-digital converter. The threshold voltage Vth of the driving transistor satisfies a formula: $Vth=Vg-Vs$.

However, during the use of the driving transistor, the threshold voltage of the driving transistor may drift due to an influence of factors such as process conditions and time of use, so that the source voltage on the source electrode of the driving transistor is changed accordingly. The source voltage may exceed a detection range of the analog-to-digital converter, and therefore the accuracy of the detected threshold voltage of the driving transistor is affected.

SUMMARY

At least one embodiment of the present disclosure provides a detecting method for detecting threshold voltages of driving transistors, comprising:

loading data signals and reference signals on respective driving transistors in a detection group;

when the respective driving transistors in the detection group are in a turn-off state, detecting first-electrode voltages of the respective driving transistors in the detection group;

determining a target adjustment set in the detection group according to the first-electrode voltages of the respective driving transistors in the detection group and a preset voltage range; and for each target driving transistor in the target adjustment set:

adjusting at least one of a data signal and a reference signal loaded on the target driving transistor;

when the target driving transistor is in the turn-off state, detecting a first-electrode target voltage of the target driving transistor; and determining a threshold voltage of the target driving transistor according to the first-electrode target voltage of the target driving transistor.

For example, in the detecting method provided by an embodiment of the present disclosure, determining the target adjustment set in the detection group according to the first-electrode voltages of the respective driving transistors in the detection group and the preset voltage range, comprises:

counting a first number of driving transistors whose first-electrode voltages are not within the preset voltage range in the detection group;

when the first number is greater than a first threshold, determining that the target adjustment set comprises at least a part of the respective driving transistors in the detection group.

For example, in the detecting method provided by an embodiment of the present disclosure, for each target driving transistor in the target adjustment set, adjusting at least one of the data signal and the reference signal loaded on the target driving transistor, comprises:

adjusting at least one of data signals and reference signals loaded on target driving transistors in the target adjustment set until a quantity of driving transistors whose first-electrode voltages are not within the preset voltage range in the detection group is less than or equal to the first threshold.

For example, in the detecting method provided by an embodiment of the present disclosure, the respective driving transistors in the detection group are arranged in a plurality of rows and a plurality of columns, and determining the target adjustment set in the detection group according to the first-electrode voltages of the respective driving transistors in the detection group and the preset voltage range, comprises:

counting a second number of driving transistors whose first-electrode voltages are not within the preset voltage range in an i-th driving transistor column;

when the second number is greater than a second threshold, determining that the target adjustment set comprises at least a part of driving transistors in the i-th driving transistor column;

here the i is a positive integer between 1 and N, and the N is a quantity of columns of the respective driving transistors in the detection group.

For example, in the detecting method provided by an embodiment of the present disclosure, for each target driving transistor in the target adjustment set, adjusting at least one of the data signal and the reference signal loaded on the target driving transistor, comprises:

adjusting at least one of data signals and reference signals loaded on target driving transistors in the target adjustment set until a quantity of driving transistors whose first-electrode voltages are not within the preset voltage range in the i-th driving transistor column is less than or equal to the second threshold.

For example, in the detecting method provided by an embodiment of the present disclosure, adjusting at least one of the data signal and the reference signal loaded on the target driving transistor, comprises:

when a first-electrode voltage of the target driving transistor is greater than an upper limit value of the preset voltage range, reducing the data signal, or increasing the reference signal, or simultaneously reducing the data signal and increasing the reference signal; and when the first-electrode voltage of the target driving transistor is less than a lower limit value of the preset voltage range, increasing the data signal, or reducing the reference signal, or simultaneously increasing the data signal and reducing the reference signal.

For example, in the detecting method provided by an embodiment of the present disclosure, adjusting at least one of the data signal and the reference signal loaded on the target driving transistor, comprises:

determining a third number of target driving transistors whose first-electrode voltages are greater than an upper limit value of the preset voltage range;

determining a fourth number of target driving transistors whose first-electrode voltages are less than a lower limit value of the preset voltage range;

when the third number is greater than the fourth number, reducing the data signal, or increasing the reference signal, or simultaneously reducing the data signal and increasing the reference signal; and when the third number is less than the fourth number, increasing the data signal, or reducing the reference signal, or simultaneously increasing the data signal and reducing the reference signal.

For example, in the detecting method provided by an embodiment of the present disclosure, when the respective driving transistors in the detection group are in the turn-off state, detecting the first-electrode voltages of the respective driving transistors in the detection group, comprises: adopting analog-to-digital converters to detect the first-electrode voltages on first electrodes of the respective driving transistors in the detection group when the respective driving transistors are in the turn-off state.

For example, the detecting method provided by an embodiment of the present disclosure further comprises:

when a first-electrode voltage of a corresponding driving transistor output by a corresponding analog-to-digital converter is a maximum output value of the corresponding analog-to-digital converter, determining that the first-electrode voltage of the corresponding driving transistor is greater than the upper limit value of the preset voltage range;

when the first-electrode voltage of the corresponding driving transistor output by the corresponding analog-to-digital converter is a minimum output value of the corresponding analog-to-digital converter, determining that the first-electrode voltage of the corresponding driving transistor is less than the lower limit value of the preset voltage range.

For example, in the detecting method provided by an embodiment of the present disclosure, loading the data signals and the reference signals on the respective driving transistors in a detection group comprises:

loading the data signals to gate electrodes of the respective driving transistors in the detection group; and loading the reference signals to first electrodes of the respective driving transistors in the detection group.

At least one embodiment of the present disclosure further provides a detecting device for detecting threshold voltages of driving transistors, comprising:

a loading module, configured to load data signals and reference signals on respective driving transistors in a detection group;

a detecting module, configured to detect first-electrode voltages of the respective driving transistors in the detection group when the respective driving transistors in the detection group are in a turn-off state;

a first determining module, configured to determine a target adjustment set in the detection group according to the first-electrode voltages of the respective driving transistors in the detection group and a preset voltage range;

an adjustment module, configured to for each target driving transistor in the target adjustment set, adjust at least one of a data signal and a reference signal loaded on the target driving transistor in the target adjustment set;

the detecting module, further configured to detect a first-electrode target voltage of the target driving transistor when the target driving transistor is in the turn-off state; and a second determining module, configured to determine a threshold voltage of the target driving transistor according to the detected first-electrode target voltage of the target driving transistor.

For example, in the detecting device provided by an embodiment of the present disclosure, the first determining module is configured to:

counting a first number of driving transistors whose first-electrode voltages are not within the preset voltage range in the detection group; and when the first number is greater than a first threshold, determining that the target adjustment set comprises at least a part of the respective driving transistors in the detection group.

For example, in the detecting device provided by an embodiment of the present disclosure, the adjustment module is configured to adjust at least one of data signals and reference signals loaded on target driving transistors in the target adjustment set until a quantity of driving transistors whose first-electrode voltages are not within the preset voltage range in the detection group is less than or equal to the first threshold.

For example, in the detecting device provided by an embodiment of the present disclosure, the respective driving transistors in the detection group are arranged in a plurality of rows and a plurality of columns, and the first determining module is configured to:

counting a second number of driving transistors whose first-electrode voltages are not within the preset voltage range in an i-th driving transistor column;

when the second number is greater than a second threshold, determining that the target adjustment set comprises at least a part of driving transistors in the i-th driving transistor column;

here the i is a positive integer between 1 and N, and the N is a quantity of columns of the respective driving transistors in the detection group.

For example, in the detecting device provided by an embodiment of the present disclosure, the adjustment module is configured to adjust at least one of the data signals and the reference signals loaded on target driving transistors in the target adjustment set until a quantity of driving transistors whose first-electrode voltages are not within the preset voltage range in the i-th driving transistor column is less than or equal to the second threshold.

For example, in the detecting device provided by an embodiment of the present disclosure, the adjustment module is configured to:

when the first-electrode voltage of the target driving transistor is greater than an upper limit value of the preset voltage range, reduce the data signal, or increase the reference signal, or simultaneously reduce the data signal and increase the reference signal; and when the first-electrode voltage of the target driving transistor is less than a lower limit value of the preset voltage range, increase the data signal, or reduce the reference signal, or simultaneously increase the data signal and reduce the reference signal.

For example, in the detecting device provided by an embodiment of the present disclosure, the adjustment module is configured to:

determine a third number of target driving transistors whose first-electrode voltages are greater than an upper limit value of the preset voltage range;

determine a fourth number of target driving transistors whose first-electrode voltages are less than a lower limit value of the preset voltage range;

when the third number is greater than the fourth number, reduce the data signal, or increase the reference signal, or simultaneously reduce the data signal and increase the reference signal; and when the third number is less than the fourth number, increase the data signal, or reduce the reference signal, or simultaneously increase the data signal and reduce the reference signal.

For example, in the detecting device provided by an embodiment of the present disclosure, the detecting module comprises analog-to-digital converters, and the analog-to-digital converters are configured to detect the first-electrode voltages on first electrodes of the respective driving transistors in the detection group when the respective driving transistors are in the turn-off state.

For example, the detecting device provided by an embodiment of the present disclosure further comprises:

a third determining module, configured to: when a first-electrode voltage of a corresponding driving transistor output by a corresponding analog-to-digital converter is a maximum output value of the corresponding analog-to-digital converter, determine that the first-electrode voltage of the corresponding driving transistor is greater than the upper limit value of the preset voltage range; and when the first-electrode voltage of the corresponding driving transistor output by the corresponding analog-to-digital converter is a minimum output value of the corresponding analog-to-digital converter, determine that the first-electrode voltage of the corresponding driving transistor is less than the lower limit value of the preset voltage range.

For example, in the detecting device provided by an embodiment of the present disclosure, the loading module is configured to load the data signals to gate electrodes of the respective driving transistors in the detection group; and load the reference signals to first electrodes of the respective driving transistors in the detection group.

BRIEF DESCRIPTION OF THE DRAWINGS

In order to clearly illustrate the technical solutions in the embodiments of the disclosure, the drawings required for describing the embodiments will be briefly described in the following; it is obvious that the described drawings are only related to some embodiments of the present disclosure; and for those skilled in the art can obtain other drawing(s) based on these drawings, without any inventive work.

FIG. 2-1 is a flow chart of another detecting method for detecting threshold voltages of driving transistors provided by an embodiment of the present disclosure;

FIG. 2-2 is a schematic diagram of a pixel circuit provided by an embodiment of the present disclosure;

FIG. 2-3 is a schematic diagram of a variation curve of a gate voltage and a variation curve of a first-electrode voltage during a charging process according to an embodiment of the present disclosure;

FIG. 3-1 is a flow chart of a method for determining target driving transistors provided by an embodiment of the present disclosure;

FIG. 3-2 is a flow chart of another method for determining target driving transistors provided by an embodiment of the present disclosure;

FIG. 3-3 is a structural block diagram of a detecting device for detecting threshold voltages of driving transistors provided by an embodiment of the present disclosure;

FIG. 4-1 is a structural schematic diagram of a detecting device for detecting threshold voltages of driving transistors provided by an embodiment of the present disclosure; and FIG. 4-2 is another structural schematic diagram of a detecting device for detecting threshold voltages of driving transistors provided by an embodiment of the present disclosure.

DETAILED DESCRIPTION

Figure 1:
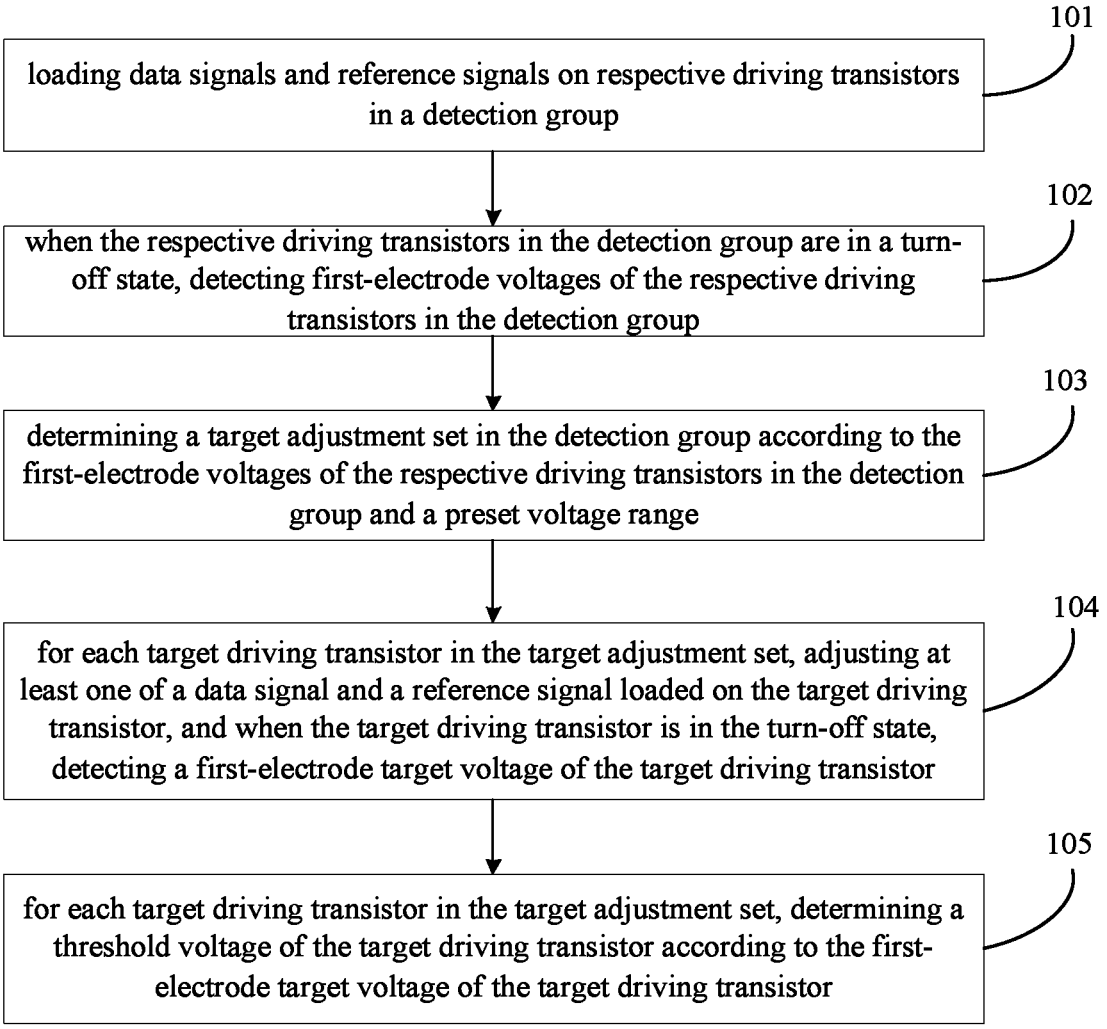
FIG. 1 is a flow chart of a detecting method for detecting threshold voltages of driving transistors provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments of the present disclosure here, those skilled in the art can obtain other embodiment(s), without any inventive work, which should be within the scope of the disclosure.

An active matrix organic light-emitting diode (AMOLED) display panel and other display panels have advantages such as a fast response time, high luminous efficiency, high brightness and a wide viewing angle. An OLED display panel comprises a plurality of pixels. Each pixel is provided with a driving transistor and a light-emitting diode, and a driving current output by the driving transistor is used to drive the light-emitting diode to emit light.

In practical applications, a threshold voltage of the driving transistor may be affected by process conditions and a driving environment, thereby leading to that driving currents output from a plurality of driving transistors in the display panel are different under a same data signal, and furthermore luminance uniformity of the display panel is affected. Currently, devices such as an analog-to-digital converter can detect the threshold voltage of the driving transistor, and the data signal applied to each pixel can be adjusted according to the threshold voltage of the driving transistor to compensate the threshold voltage of the driving transistor, so as to improve the luminance uniformity of the display panel.

However, because the devices such as the analog-to-digital converter have a fixed detection range, and the threshold voltage of the driving transistor may drift, so that the detected threshold voltage of the driving transistor is inaccurate, resulting in that the brightness of the display panel after compensation based on the detected threshold voltage is still uneven.

The embodiments of the present disclosure provide a detecting method for detecting threshold voltages of driving transistors and a detecting device thereof, which can solve the following problem that: when a threshold voltage of a driving transistor drifts, and a source voltage on a source electrode of the driving transistor is changed accordingly, the source voltage may exceed a detection range of the analog-to-digital converter, so as to affect the accuracy of the detected threshold voltage of the driving transistor.

A technical solution provided by the embodiments of the present disclosure has the following beneficial effects:

The detecting method for detecting threshold voltages of driving transistors and the detecting device thereof provided by the embodiments of the present disclosure can detect first-electrode voltages on first electrodes of respective driving transistors when the respective driving transistors are in a turn-off state, determine a target driving transistor according to the first-electrode voltages, and then adjust at least one of a data signal and a reference signal applied to the target driving transistor, so that a first-electrode target voltage (namely, an adjusted first-electrode voltage) of the target driving transistor is within a preset voltage range, and a threshold voltage of the target driving transistor is determined according to the first-electrode target voltage. At least one of the data signal and the reference signal applied to each target driving transistor can be dynamically adjusted according to the detected first-electrode voltage of each target driving transistor, so that a detected threshold voltage of the respective target driving transistor is closer to or equal to an actual threshold voltage of the respective target driving transistor. Thus, the accuracy of the detected threshold voltage of the target driving transistor is effectively improved.

An embodiment of the present disclosure provides a detecting method for detecting threshold voltages of driving transistors, and the detecting method can be applied to driving transistors on a display panel.

FIG. 1 is a flow chart of a detecting method for detecting threshold voltages of driving transistors provided by an embodiment of the present disclosure. As shown in FIG. 1, the detecting method may comprise:

Step S101, loading data signals and reference signals on respective driving transistors in a detection group;

Step S102, when the respective driving transistors in the detection group are in a turn-off state, detecting first-electrode voltages of the respective driving transistors in the detection group;

Step S103, determining a target adjustment set in the detection group according to the first-electrode voltages of the respective driving transistors in the detection group and a preset voltage range;

Step S104, for each target driving transistor in the target adjustment set, adjusting at least one of a data signal and a reference signal loaded on the target driving transistor, and when the target driving transistor is in the turn-off state, detecting a first-electrode target voltage of the target driving transistor; and Step S105, for each target driving transistor in the target adjustment set, determining a threshold voltage of the target driving transistor according to the first-electrode target voltage of the target driving transistor.

In summary, the detecting method for detecting the threshold voltages of the driving transistors provided by an embodiment of the present disclosure can detect first-electrode voltages on first electrodes of the respective driving transistors when the respective driving transistors are in a turn-off state, determine each respective target driving transistor according to the first-electrode voltages, and then adjust at least one of a data signal and a reference signal applied to each respective target driving transistor, so that a first-electrode target voltage (namely, an adjusted first-electrode voltage) of each respective target driving transistor is within a preset voltage range, a threshold voltage of each respective target driving transistor is determined according to the first-electrode target voltage. At least one of the data signal and the reference signal applied to each target driving transistor can be dynamically adjusted according to the detected first-electrode voltage of each target driving transistor, so that the detected threshold voltage of the target driving transistor is closer to or equal to an actual threshold voltage of the target driving transistor. Thus, accuracy of the detected threshold voltages of the driving transistors is effectively improved.

For example, a driving transistor in the target adjustment set is referred to as a target driving transistor. The target adjustment set may include one or more target driving transistors. Steps S104 and S105 described above may be performed for each target driving transistor in the target adjustment set respectively.

For example, the first-electrode target voltage may be a voltage on a first electrode of the target driving transistor.

Figures 1, 2:
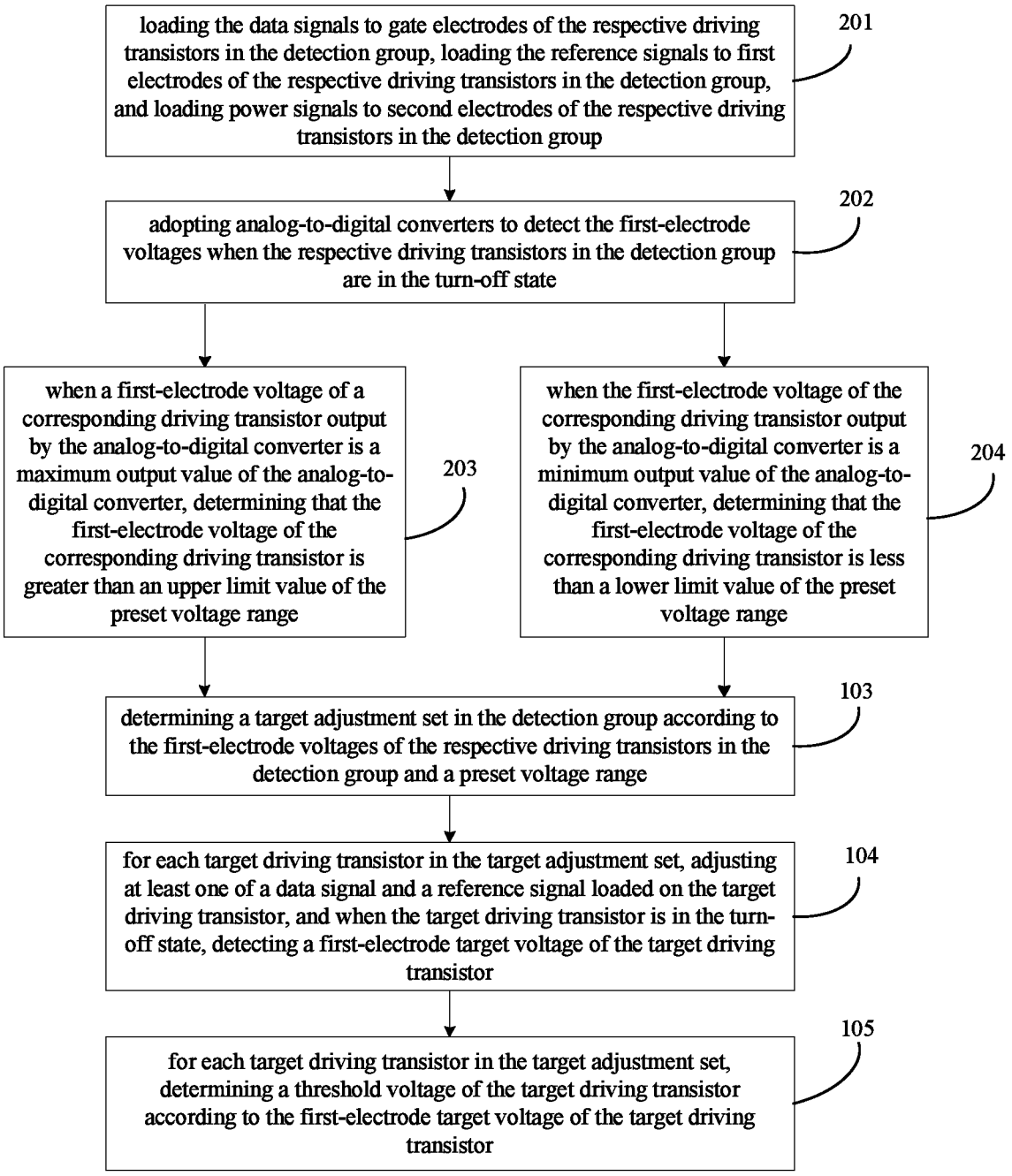
Figure 2:
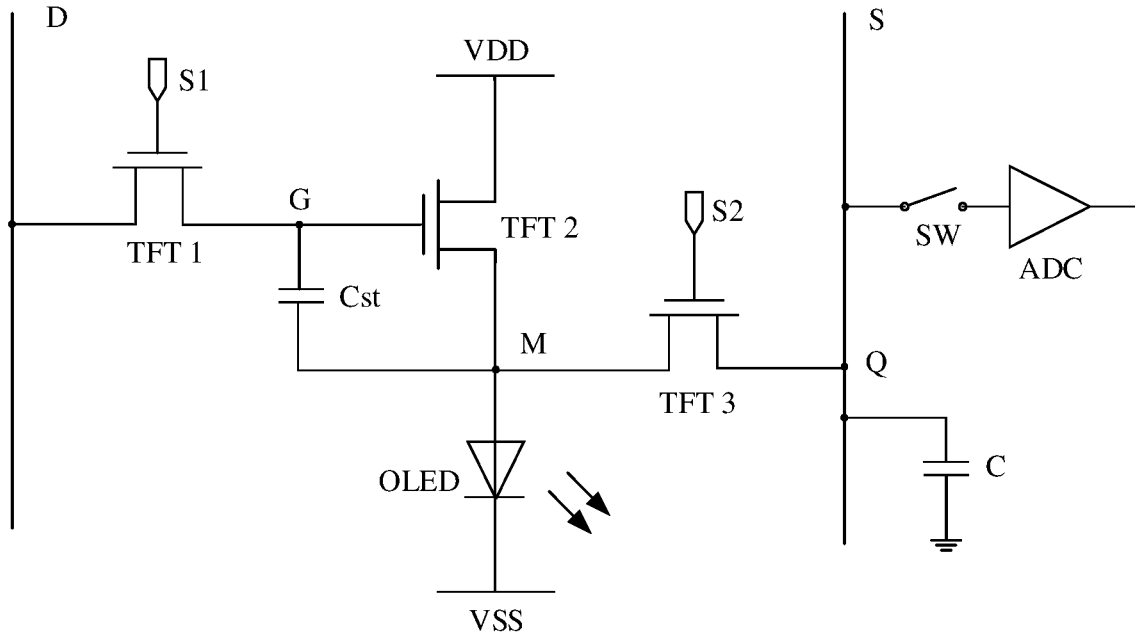

FIG. 2-1 is a flow chart of another detecting method for detecting threshold voltages of driving transistors provided by an embodiment of the present disclosure, and FIG. 2-2 is a schematic diagram of a pixel circuit provided by an embodiment of the present disclosure.

For example, as shown in FIG. 2-1, in the detecting method, the step S101 may comprise:

Step S201, loading the data signals to gate electrodes of the respective driving transistors in the detection group, loading the reference signals to first electrodes of the respective driving transistors in the detection group, and loading power signals to second electrodes of the respective driving transistors in the detection group.

For example, a pixel circuit diagram for detecting the threshold voltage of the driving transistor may be illustrated in FIG. 2-2, a pixel circuit may comprise a switching transistor TFT1, a driving transistor TFT2, a sensing transistor TFT3, a storage capacitor Cst, a liquid crystal capacitor C and an analog-to-digital converter ADC. A gate electrode of the switching transistor TFT1 is connected to a first signal terminal S1, a first electrode of the switching transistor TFT1 is connected to a data line D, and a second electrode of the switching transistor TFT1 is connected to a first node G. A gate electrode of the driving transistor TFT2 is connected to the first node G, a first electrode of the driving transistor TFT2 is connected to a second node M, and a second electrode of the driving transistor TFT2 is connected to a first power signal terminal VDD. A gate electrode of the sensing transistor TFT3 is connected to a second signal terminal S2, a first electrode of the sensing transistor TFT3 is connected to the second node M, and a second electrode of the sensing transistor TFT3 is connected to a third node Q. One end of the light-emitting diode OLED is connected to the second node M, and the other end of the light-emitting diode OLED is connected to a second power signal terminal VSS. The light-emitting diode OLED is driven to emit light by the driving transistor TFT2. One end of a sampling switch SW is connected to the third node Q, and the other end of the sampling switch SW is connected to the analog-to-digital converter ADC. One end of the liquid crystal capacitor C is connected to the third node Q, and the other end of the liquid crystal capacitor C is grounded. Two ends of the storage capacitor Cst are respectively connected to the first node G and the second node M.

During a process of detecting the threshold voltage of the driving transistor, firstly, a first gate driving signal is applied to the gate electrode of the switching transistor TFT1 through the first signal terminal S1, and a second gate driving signal is applied to the gate electrode of the sensing transistor TFT3 through the second signal terminal S2, so that the switching transistor TFT1 and the sensing transistor TFT3 are turned on; then, a data signal is applied to the gate electrode of the driving transistor TFT2 through the data line D, a reference signal is applied to the first electrode of the driving transistor TFT2 through a sensing line S, and a power signal is applied to the second electrode of the driving transistor TFT2 through the first power signal terminal VDD, so that the driving transistor TFT2 is turned on and outputs a current. The data signal, the reference signal and the power signal may be preset and fixed in advance, and the data signal is larger than the reference signal, and the current output from the driving transistor TFT2 charges the liquid crystal capacitor C via the sensing transistor TFT3.

For example, the first signal terminal S1 and the second signal terminal S2 may be connected with a same gate line, so that the first gate driving signal and the second gate driving signal are the same signal. However, the present disclosure is not limited thereto, the first signal terminal S1 and the second signal terminal S2 may also be respectively connected with different gate lines, and the first gate driving signal and the second gate driving signal are different signals.

For example, as shown in FIG. 2-1, the step S102 may comprise:

Step S202, adopting analog-to-digital converters to detect the first-electrode voltages when the respective driving transistors in the detection group are in the turn-off state.

For example, a first-electrode voltage may be a voltage on a first electrode of a driving transistor.

For example, in a process that the current output from the driving transistor TFT2 charges the liquid crystal capacitor C, a voltage at an end of the liquid crystal capacitor C that is connected to the second electrode of the sensing transistor TFT3 (namely, a voltage of the third node Q, and the voltage of the third node Q being regarded as to be equal to a voltage of the second node M) gradually increases. When the voltage of the third node Q rises up to be equal to a difference between the data signal and the threshold voltage of the driving transistor TFT2 (for example, if the voltage of the third node Q is represented as V1, the data signal is represented as Vdata, and the threshold voltage of the driving transistor TFT2 is represented as Vth, then V1=Vdata−Vth), the driving transistor TFT2 is in the turn-off state, and stops outputting the current. At this point, the sampling switch SW is turned on, the analog-to-digital converter ADC can obtain the voltage V1 of the third node Q through the sampling switch SW, convert the voltage of the third node Q into a digital voltage, and then output the digital voltage. The output digital voltage is a first-electrode voltage Vs of the driving transistor TFT2. A difference between the gate voltage Vg (that is, the data signal Vdata) on the gate electrode of the driving transistor TFT2 and the first-electrode voltage Vs of the driving transistor TFT2 is the threshold voltage Vth of the driving transistor, that is, the threshold voltage satisfies: Vth=Vg−Vs.

Figures 2, 3:
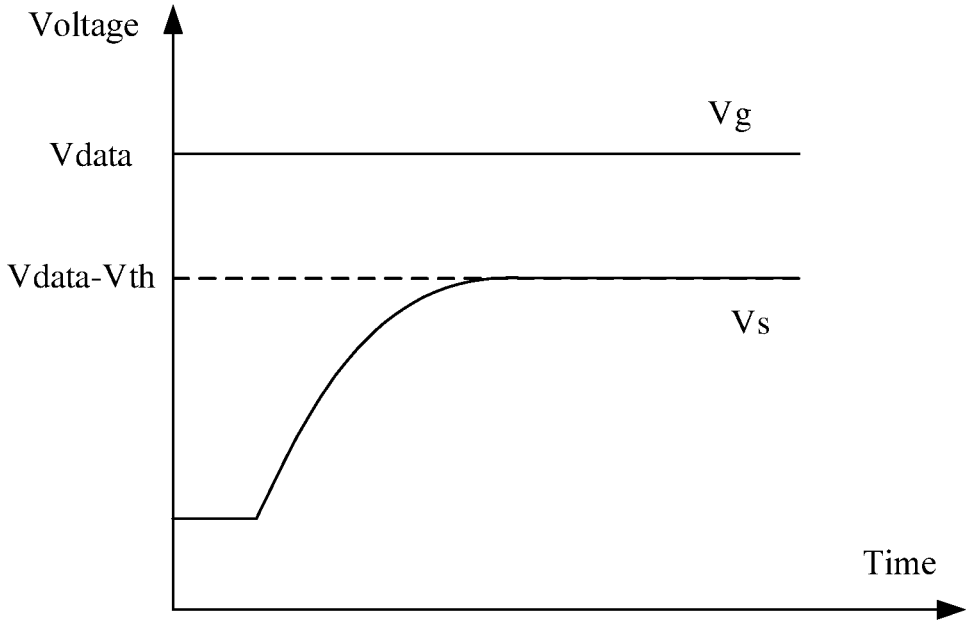
Figures 1, 3:
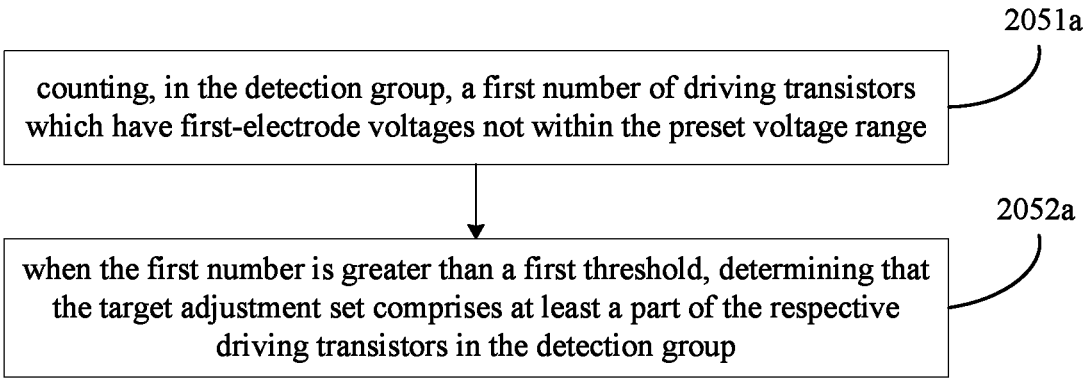
Figures 2, 3:
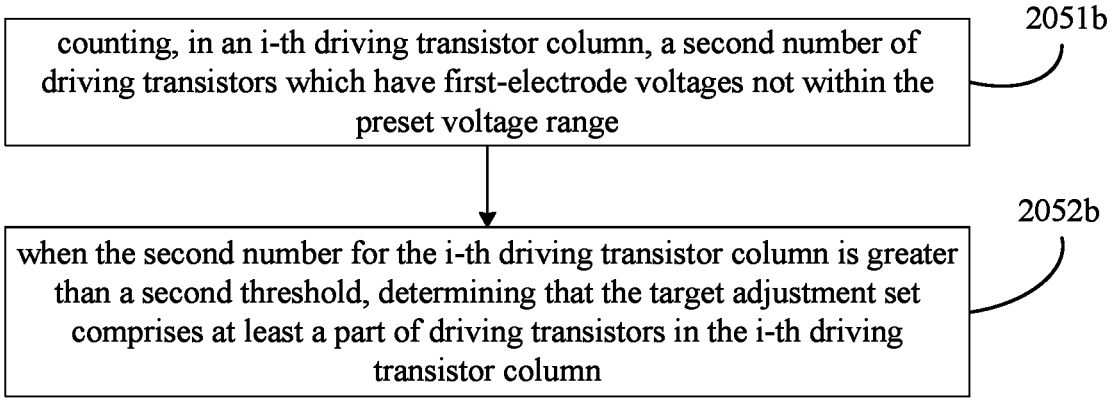
Figure 3:
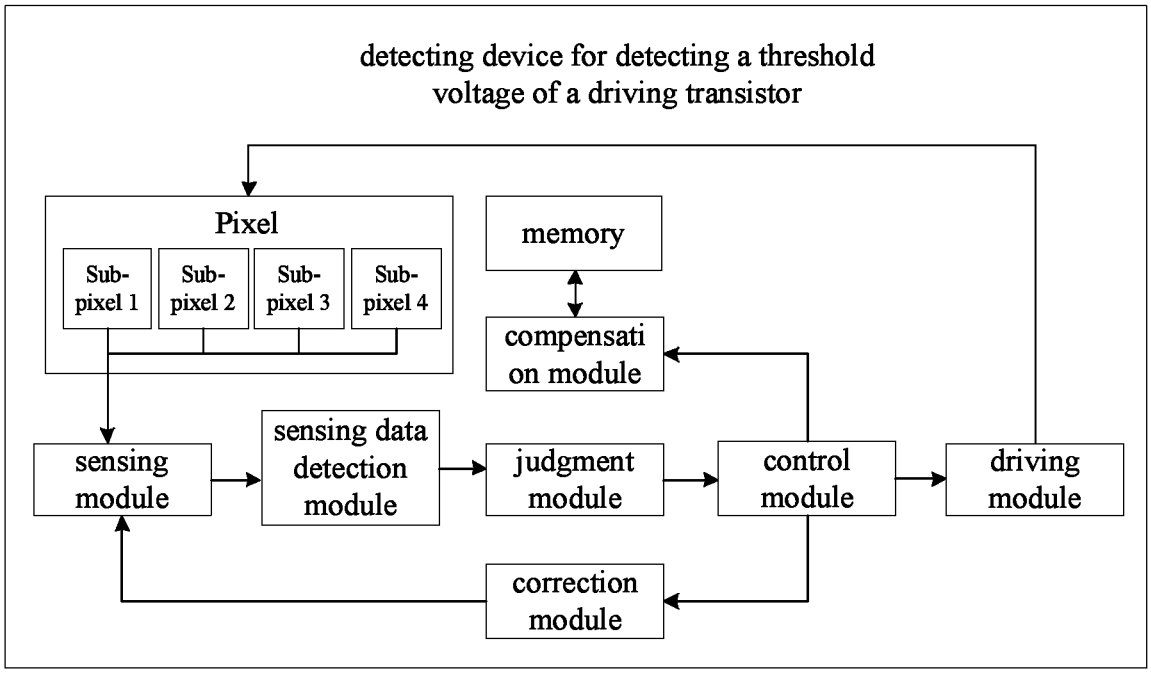

FIG. 2-3 is a schematic diagram of a variation curve of a gate voltage and a variation curve of a first-electrode voltage during a charging process according to an embodiment of the present disclosure. During a charging process, a variation curve of a gate voltage Vg and a variation curve of a first-electrode voltage Vs of the driving transistor TFT2 can be shown in FIG. 2-3. As it can be seen from FIG. 2-3, during the charging process, the gate voltage Vg is a constant value, and a voltage value of the gate voltage Vg is equal to the data signal Vdata. A voltage value of the first-electrode voltage Vs rises continuously during the charging process, and the voltage value of the first-electrode voltage Vs hardly changes after rising up to Vdata−Vth.

For example, as shown in FIG. 2-1, the detecting method further comprises:

Step S203, when a first-electrode voltage of a corresponding driving transistor output by a corresponding analog-to-digital converter is a maximum output value of the corresponding analog-to-digital converter, determining that the first-electrode voltage of the corresponding driving transistor is greater than an upper limit value of the preset voltage range.

Because the analog-to-digital converter ADC has a fixed detecting range, when the first-electrode voltage of the driving transistor is greater than a maximum value that the analog-to-digital converter ADC can detect, the analog-to-digital converter ADC outputs the maximum output value. Therefore, when an output value of the analog-to-digital converter ADC is the maximum output value of the analog-to-digital converter, it can be determined that the first-electrode voltage is greater than the upper limit value of the preset voltage range.

For example, assuming that a detection range of the analog-to-digital converter ADC is 0 to 3 volts (V), due to the limitation of the detection range of the analog-to-digital converter ADC, when the voltage V1 of the third node Q is 3V and 4V respectively, voltage values output by the analog-to-digital converter ADC are 1023 (binary) respectively, that is, the output voltage values are the maximum output value 3V of the analog-to-digital converter ADC. Therefore, when the voltage value output by the analog-to-digital converter is the maximum output value of the analog-to-digital converter, it can be determined that the first-electrode voltage is greater than the upper limit value of the preset voltage range, and the upper limit value of the preset voltage range may be equal to the maximum output value of the analog-to-digital converter. The preset voltage range can be (0, 3).

For example, as shown in FIG. 2-1, the detecting method further comprises:

Step S204, when the first-electrode voltage of the corresponding driving transistor output by a corresponding analog-to-digital converter is a minimum output value of the corresponding analog-to-digital converter, determining that the first-electrode voltage of the corresponding driving transistor is less than a lower limit value of the preset voltage range.

Because the analog-to-digital converter ADC has a fixed detecting range, when the first-electrode voltage of the driving transistor is less than a minimum value that the analog-to-digital converter ADC can detect, the analog-to-digital converter ADC outputs the minimum output value. Therefore, when an output value of the analog-to-digital converter ADC is the minimum output value of the analog-to-digital converter, it can be determined that the first-electrode voltage of the driving transistor is less than the lower limit value of the preset voltage range. A principle of determining that the first-electrode voltage is less than the lower limit value of the preset voltage range may be referred to a principle of determining that the first-electrode voltage is greater than the upper limit value of the preset voltage range when the voltage value output by the analog-to-digital converter is the maximum output value of the analog-to-digital converter in the step S203, and similar descriptions will be omitted here.

It should be noted that, when the first-electrode voltage of the driving transistor detected by the analog-to-digital converter is within the preset voltage range, it may be determined that the detected first-electrode voltage of the driving transistor is an accurate voltage, and in this case, the threshold voltage of the driving transistor may be directly determined according to the first-electrode voltage of the driving transistor.

For example, the display panel comprises a plurality of pixels arranged in an array, and the respective driving transistors in the detection group may be driving transistors in the plurality of pixels. When scan lines light up the plurality of pixels line-by-line, threshold voltages of driving transistors of pixels in a lighted pixel row can be detected, and a quantity of abnormal driving transistors in the pixels in the lighted pixel row is counted, where first-electrode voltages of the abnormal driving transistors are not within the preset voltage range. Of course, after lighting up a plurality of pixel rows on the whole display panel, a total number of abnormal driving transistors in all pixels on the display panel may be counted; alternatively, a total number of abnormal driving transistors in each pixel column may be counted.

FIG. 3-1 is a flow chart of a method for determining target driving transistors provided by an embodiment of the present disclosure; FIG. 3-2 is a flow chart of another method for determining target driving transistors provided by an embodiment of the present disclosure.

According to different ways of counting the total number of the abnormal driving transistors, the method for determining the target adjustment set in the detection group may comprise at least the following implementation manners:

For example, in a first implementation manner, as shown in FIG. 3-1, the step S103 may comprise:

Step S2051*a*, counting, in the detection group, a first number of driving transistors which have first-electrode voltages not within the preset voltage range.

For example, the display panel comprises 40000 driving transistors, that is, the detection group comprises 40000 driving transistors. Assuming that all the pixels on the display panel are lit up, the number of the abnormal driving transistors is determined to be 1000. That is, the first-electrode voltages of 1000 driving transistors in the detection group are not within the preset voltage range, namely the first number is 1000.

For example, the step S103 may further comprise:

Step S2052*a*, when the first number is greater than a first threshold, determining that the target adjustment set comprises at least a part of the respective driving transistors in the detection group.

For example, in the step S2052*a*, the target adjustment set comprises a part or all of the driving transistors in the detection group. For example, when the first number is greater than the first threshold, it can be considered that the threshold voltages of most of the driving transistors on the display panel have drifted, and the target adjustment set can comprise all the driving transistors in the detection group (namely all the driving transistors on the display panel). That is, all the driving transistors in the detection group are target driving transistors. However, the present disclosure is not limited thereto. The target adjustment set may only comprise a part of the driving transistors in the detection group; for example, the target adjustment set may only comprise the driving transistors in the detection group which have the first-electrode voltages not within the preset voltage range. That is, the driving transistors in the detection group, which have the first-electrode voltages not within the preset voltage range, are the target driving transistors.

For example, assuming that the first number is 1000, the first threshold is 500, then the target adjustment set may comprise 40000 driving transistors (that is, the 40000 driving transistors included in the display panel) in the detection group, that is, the 40000 driving transistors in the detection group are the target driving transistors. Alternatively, the target adjustment set may only comprise the driving transistors in the detection group which have the first-electrode voltages not within the preset voltage range (that is, the 1000 driving transistors).

It should be noted that, when the first number is less than the first threshold, it can be considered as only the threshold voltages of a few driving transistors in the detection group have drifted. In this case, the data signals and the reference signals may not be adjusted. However, the present disclosure is not limited thereto. For example, when the first number is less than the first threshold, the target adjustment set may also comprise driving transistors from the detection group which have the first-electrode voltages not within the preset voltage range.

For example, because the respective driving transistors in the detection group may be the driving transistors in the plurality of pixels on the display panel, and the plurality of pixels are arranged in multiple rows and multiple columns, the respective driving transistors in the detection group are also arranged in multiple rows and multiple columns. Therefore, in a second implementation manner, as shown in FIG. 3-2, the step S103 may comprise:

Step S2051*b*, counting, in an i-th driving transistor column, a second number of driving transistors which have first-electrode voltages not within the preset voltage range.

For example, the symbol i is a positive integer between 1 and N, and the symbol N is a quantity of columns of the respective driving transistors in the detection group.

For example, in the step S2051*b*, the numbers of driving transistors which have first-electrode voltages not within the preset voltage range can be counted respectively for N driving transistor columns, so as to obtain N second numbers. The N second numbers may be different from each other or at least some of the N second numbers are identical. However, the present disclosure is not limited thereto. For example, in the step S2051*b*, the numbers of driving transistors which have first-electrode voltages not within the preset voltage range can be counted respectively for only M driving transistor columns, so as to obtain M second numbers, where M is a positive integer and is less than N.

For example, each column of pixels on the display panel may be connected with the same data line D and the same sensing line S. Each pixel column may correspond to a counter. For example, if a quantity of columns of the respective driving transistors in the detection group is N, that is, the display panel comprises N pixel columns, a quantity of counters may also be N, and the N counters correspond to the N pixel columns in a one-to-one correspondence. After lighting up a certain pixel row, if it is determined that a first-electrode voltage corresponding to a driving transistor of a pixel located in a certain column of the certain pixel row is not within the preset voltage range, the counter for the certain column may be increased by one. Alternatively, if it is determined that first-electrode voltages corresponding to n driving transistors of the pixel located in a certain column of the certain pixel row are not within the preset voltage range, the counter for the certain column may be increased by n (for example, a pixel may be provided with n sub-pixels, each sub-pixel corresponds to a driving transistor; when the first-electrode voltages of the driving transistors corresponding to the n sub-pixels of the pixel are not within the preset voltage range, the counter is increased by n; for example, n may be 3 or 4 and so on). After lighting up all the pixels on the display panel, according to the number output by an i-th counter, a quantity of abnormal driving transistors in the i-th pixel column of the display panel (that is, the second number corresponding to the i-th driving transistor column) can be determined, where i is a positive integer between 1 and N. For example, assuming that the i-th pixel column comprises 1000 driving transistors, and the number output by the i-th counter is 300, then the quantity of the abnormal driving transistors in the i-th pixel column is 300, and the second number corresponding to the i-th driving transistor column is 300.

For example, the step S103 may further comprise:

Step 2052*b*, when the second number for the i-th driving transistor column is greater than a second threshold, determining that the target adjustment set comprises at least a part of driving transistors in the i-th driving transistor column.

For example, in the step S2052*b*, the target adjustment set comprises a part or all of the driving transistors in the i-th driving transistor column. For example, when the second number for the i-th driving transistor column is greater than the second threshold, the threshold voltages of most of the driving transistors in the i-th driving transistor column (namely the driving transistors included in the i-th driving transistor column) may have drifted, and then the target adjustment set may comprise all the driving transistors in the i-th driving transistor column (that is, all the driving transistors included in an i-th pixel column). That is, all the driving transistors in the i-th driving transistor column are target driving transistors. However, the present disclosure is not limited thereto. For example, the target adjustment set may only comprise a part of the driving transistors in the i-th driving transistor column, for example, the target adjustment set may only comprise the driving transistors in the i-th driving transistor column whose first-electrode voltages are not within the preset voltage range. That is, in the i-th driving transistor column, the driving transistors whose first-electrode voltages are not within the preset voltage range are the target driving transistors.

It should be noted that, when the second number for the i-th driving transistor column is less than the second threshold, only the threshold voltages of a few driving transistors in the i-th driving transistor column have drifted. In this case, the data signals and the reference signals may not be adjusted. However, the present disclosure is not limited thereto. For example, when the second number is less than the second threshold, the target adjustment set may also comprise driving transistors from the i-th driving transistor column, which have the first-electrode voltages not within the preset voltage range.

For example, assuming that a quantity of driving transistors in the i-th driving transistor column is 1000 (that is, the i-th pixel column comprises 1000 driving transistors), and the second number is 300, the second threshold is 50. Because the second number is greater than the second threshold, then the target adjustment set may comprise 1000 driving transistors in the i-th driving transistor column (that is, the 1000 driving transistors included in the i-th pixel column). Alternatively, the target adjustment set may only comprise the driving transistors in the i-th driving transistor column whose first-electrode voltages are not within the preset voltage range (that is, the 300 driving transistors).

For example, in an example, if the data signal is adjusted, the step S104 may comprise: when a first-electrode voltage of the target driving transistor is greater than an upper limit value of the preset voltage range, reducing the data signal; and when the first-electrode voltage of the target driving transistor is less than a lower limit value of the preset voltage range, increasing the data signal. If the reference signal is adjusted, the step S104 may comprises: when the first-electrode voltage of the target driving transistor is greater than the upper limit value of the preset voltage range, increasing the reference signal; and when the first-electrode voltage of the target driving transistor is less than the lower limit value of the preset voltage range, reducing the reference signal.

It should be noted that, the data signal and the reference signal can be adjusted separately; however, the data signal and reference signal can also be adjusted at the same time. Therefore, the step S104 may comprise: when the first-electrode voltage of the target driving transistor is greater than the upper limit value of the preset voltage range, simultaneously reducing the data signal and increasing the reference signal; and when the first-electrode voltage of the target driving transistor is less than the lower limit value of the preset voltage range, simultaneously increasing the data signal and reducing the reference signal.

For example, in another example, the step S104 may also comprise: determining a third number of target driving transistors whose first-electrode voltages are greater than an upper limit value of the preset voltage range; determining a fourth number of target driving transistors whose first-electrode voltages are less than a lower limit value of the preset voltage range; when the third number is greater than the fourth number, reducing the data signal, or increasing the reference signal, or simultaneously reducing the data signal and increasing the reference signal; and when the third number is less than the fourth number, increasing the data signal, or reducing the reference signal, or simultaneously increasing the data signal and reducing the reference signal.

For example, in the target adjustment set, the third number of the target driving transistors whose first-electrode voltages are greater than the upper limit value of the preset voltage range is A1, and the fourth number of target driving transistors whose first-electrode voltages are less than the lower limit value of the preset voltage range is A2. When A1 is greater than A2, it means that in the target adjustment set, the first-electrode voltages of most of the target driving transistors are greater than the upper limit value of the preset voltage range, and therefore, the data signal can be reduced, or the reference signal can be increased, or the data signal can be reduced and the reference signal can be increased at the same time, so that the first-electrode target voltages of the target driving transistors, which have the first-electrode voltages not within the preset voltage range, are adjusted to be within the preset voltage range. When A1 is less than A2, it means that in the target adjustment set, the first-electrode voltages of most of the target driving transistors are less than the lower limit value of the preset voltage range, and therefore, the data signal can be increased, or the reference signal can be reduced, or the data signal can be increased and the reference signal can be reduced at the same time, so that the first-electrode target voltages of the target driving transistors, which have the first-electrode voltages are not within the preset voltage range, are adjusted to be within the preset voltage range.

When at least one of the data signal and the reference signal is adjusted, an adjustment standard is also different according to the different ways of determining the target driving transistors in the step S103.

Corresponding to the first implementation manner of determining the target driving transistors in the step S103, for example, the target adjustment set comprises all the driving transistors in the detection group (that is, all the driving transistors included in the display panel), that is, all the driving transistors in the detection group are target driving transistors. Therefore, the step S104 may comprise: adjusting at least one of the data signals and the reference signals loaded on the target driving transistors in the target adjustment set (namely all the driving transistors on the display panel) until a quantity of driving transistors in the detection group whose first-electrode voltages are not within the preset voltage range is less than or equal to the first threshold. For example, the data signals loaded on the plurality of data lines D connected with the plurality of pixels on the display panel and/or the reference signals loaded on the plurality of sensing lines S connected with the plurality of pixels on the display panel are/is adjusted until the number of the abnormal driving transistors in all the driving transistors on the display panel is less than or equal to the first threshold.

Corresponding to the second implementation manner of determining the target driving transistors in the step S103, for example, the target adjustment set comprises all the driving transistors in the i-th driving transistor column (namely, all the driving transistors included in the i-th pixel column). Because each pixel column on the display panel is connected with the same data line D and the same sensing line S, the step S104 may comprise: adjusting at least one of the data signal and the reference signal loaded on the target driving transistors in the target adjustment set (namely all the driving transistors included in the i-th driving transistor column) until, in the i-th driving transistor column, a quantity of driving transistors whose first-electrode voltages are not within the preset voltage range is less than or equal to the second threshold. For example, the data signal loaded on a data line D connected with the i-th pixel column and/or the reference signal loaded on a sensing line S connected with the i-th pixel column are/is adjusted until the number of the abnormal driving transistors in the driving transistors included in the i-th pixel column is less than or equal to the second threshold.

It should be noted that, in some embodiments, at least one of the data signal and the reference signal of each target driving transistor in the target adjustment set may be individually adjusted, and then the threshold voltage of each target driving transistor is detected, so as to ensure that the first-electrode voltage of each driving transistor in the detection group is within the preset voltage range. In some other embodiments, the data signals and/or the reference signals of multiple target driving transistors in the target adjustment set may be adjusted simultaneously. The disclosure is not limited thereto.

For example, assuming that before at least one of the data signal and the reference signal is adjusted, a data signal before adjustment is Vdata1, and Vdata1=3V, that is, a gate voltage Vg of a driving transistor is equal to the data signal Vdata1, namely Vg=Vdata1=3V. A reference signal Vref is 1V. A detection range of the analog-to-digital converter ADC is 1~4V. When an actual threshold voltage Vth of the driving transistor is 2.4V, an actual first-electrode voltage of the driving transistor before adjusting the data signal is Vs=Vg−Vth=3V−2.4V=0.6V. In this case, because the actual first-electrode voltage before adjusting the data signal is not within the detection range of the analog-to-digital converter ADC, and the actual first-electrode voltage before adjusting the data signal is less than a minimum output value of the analog-to-digital converter ADC, an output value of the analog-to-digital converter ADC is the minimum output value 1V of the analog-to-digital converter ADC (that is, a detected first-electrode voltage before adjusting the data signal is 1V), and a threshold voltage of the driving transistor before adjusting the data signal, which is determined based on the detected first-electrode voltage before adjusting the data signal, is not equal to the actual threshold voltage of the driving transistor.

In the detecting method for detecting threshold voltages of driving transistors provided by the embodiments of the present disclosure, when the detected first-electrode voltage of the driving transistor is the minimum output value of the analog-to-digital converter ADC, the data signal can be adjusted, such as increasing the data signal. For example, a data signal after adjustment is Vdata2, and the Vdata2 is 3.5V, so that an actual first-electrode voltage of the driving transistor after adjusting the data signal is Vs=Vg−Vth=Vdata2−Vth=3.5V−2.4V=1.1V. Because the actual first-electrode voltage after adjusting the data signal is within the detection range of the analog-to-digital converter ADC, an output value of the analog-to-digital converter ADC is 1.1V, that is, a detected first-electrode voltage after adjusting the data signal is 1.1V, and the detected first-electrode voltage after adjusting the data signal is the equal to the actual first-electrode voltage after adjusting the data signal. After adjusting the data signal, the threshold voltage of the driving transistor determined based on the detected first-electrode voltage after adjusting the data signal is equal to the actual first-electrode voltage of the driving transistor, so that the accuracy of the threshold voltage is improved.

It should be noted that, during adjusting at least one of the data signals and the reference signals, every time at least one of the data signals and the reference signals is changed, the step S202, the step S203, the step S204, the step S103, the step S104 and the step S105 are performed, until the number of driving transistors whose first-electrode voltages are not within the preset voltage range in the detection group is less than or equal to the first threshold, or until the number of driving transistors whose first-electrode voltages are not within the preset voltage range in the i-th driving transistor column is less than or equal to the second threshold.

For example, the threshold voltage Vth of the driving transistor TFT2 is a difference between the gate voltage Vg of the driving transistor TFT2 (that is, the voltage of the data signal) and the first-electrode voltage Vs. That is, the threshold voltage Vth satisfies: Vth=Vg−Vs. In the step S104, after adjusting at least one of the data signal and the reference signal loaded on the target driving transistor, the voltage at the first electrode of the target driving transistor when the target driving transistor is in the turn-off state is detected, so as to obtain the first-electrode target voltage. Based on the detected first-electrode target voltage Vst of each target driving transistor and the data signal Vdata2 after adjustment, the threshold voltage of each target driving transistor can be determined.

For example, assuming that a first-electrode target voltage of a target driving transistor is Vst=1.1V, and a data signal after adjustment is Vdata2=3.5V, the threshold voltage of the target driving transistor can be determined, and the threshold voltage is Vth=Vdata2−Vst=3.5V−1.1V=2.4V.

For example, the detecting method for detecting threshold voltages of driving transistors provided by the embodiments of the present disclosure further comprises: after determining the threshold voltages of the respective driving transistors in the detection group, compensating the data signals according to the threshold voltages of the driving transistors respectively. Because the detected threshold voltages of the respective driving transistors in the detection group are closer to or equal to actual threshold voltages of the respective driving transistors in the detection group respectively, the data signals can be compensated according to the detected threshold voltages of the respective driving transistors in the detection group, so as to effectively improve the accuracy of the compensation and improve brightness uniformity of the display panel.

In summary, the detecting method for detecting the threshold voltages of the driving transistors provided by the embodiments of the present disclosure can detect first-electrode voltages on first electrodes of respective driving transistors when the respective driving transistors are in a turn-off state, and determine target driving transistors according to the first-electrode voltages. Then, at least one of a data signal and a reference signal applied to each target driving transistor is adjusted, so that a first-electrode target voltage (namely, an adjusted first-electrode voltage) of each target driving transistor is within a preset voltage range, and a threshold voltage of each target driving transistor is determined according to the first-electrode target voltage. At least one of the data signal and the reference signal applied to each target driving transistor can be dynamically adjusted according to the detected first-electrode voltage of each target driving transistor, so that a detected threshold voltage of the target driving transistor is closer to or equal to an actual threshold voltage of the target driving transistor. Thus, accuracy of the detected threshold voltage of the target driving transistor is effectively improved.

It should be noted that, an order of the steps of the detecting method for detecting threshold voltages of driving transistors provided by embodiments of the present disclosure can be adjusted appropriately, and some of the steps may be added to or omitted from the detecting method according to actual conditions. Any modifications or substitutions which those skilled in the art can easily think of within the technical scope of the present disclosure should be within the protection scope of the present disclosure, and therefore the details are omitted here.

FIG. 3-3 is a structural block diagram of a detecting device for detecting threshold voltages of driving transistors provided by an embodiment of the present disclosure.

For example, one or more steps of the above detecting method may be performed by a detecting device for detecting threshold voltages of driving transistors. Referring to FIG. 3-3, the detecting device may comprise: a driving module, a sensing module, a sensing data detection module, a control module, a judgment module, a correction module, a compensation module, and a memory.

For example, the driving module may perform an operation of the above step S101, the sensing module may perform an operation of the above step S202, the sensing data detection module may perform operations of the above steps S203 and S204, the judgment module may perform an operation of the above step S103, the control module may control the compensation module to perform a compensation operation or control the correction module to perform a correction operation according to an output of the judgment module, the correction module may perform operations of the above steps S104 and S105, and the compensation module may perform an operation of compensating the data signals according to threshold voltages of the respective driving transistors in the detection group. The memory is used to store data output by the compensation module, and the data output by the compensation module may be compensation data after each pixel is compensated.

Figures 1, 4:
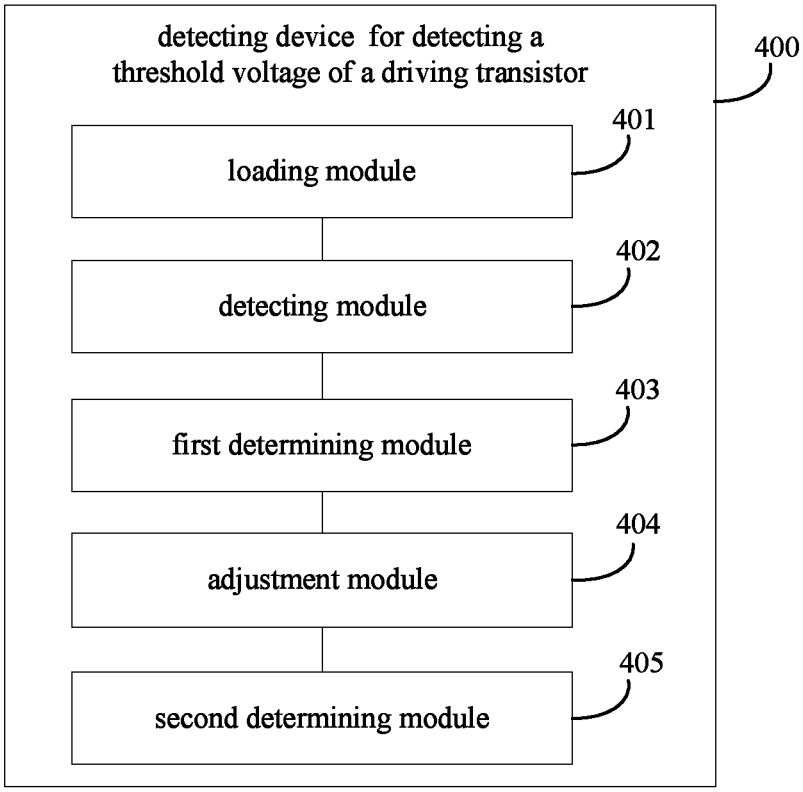
Figures 2, 4:
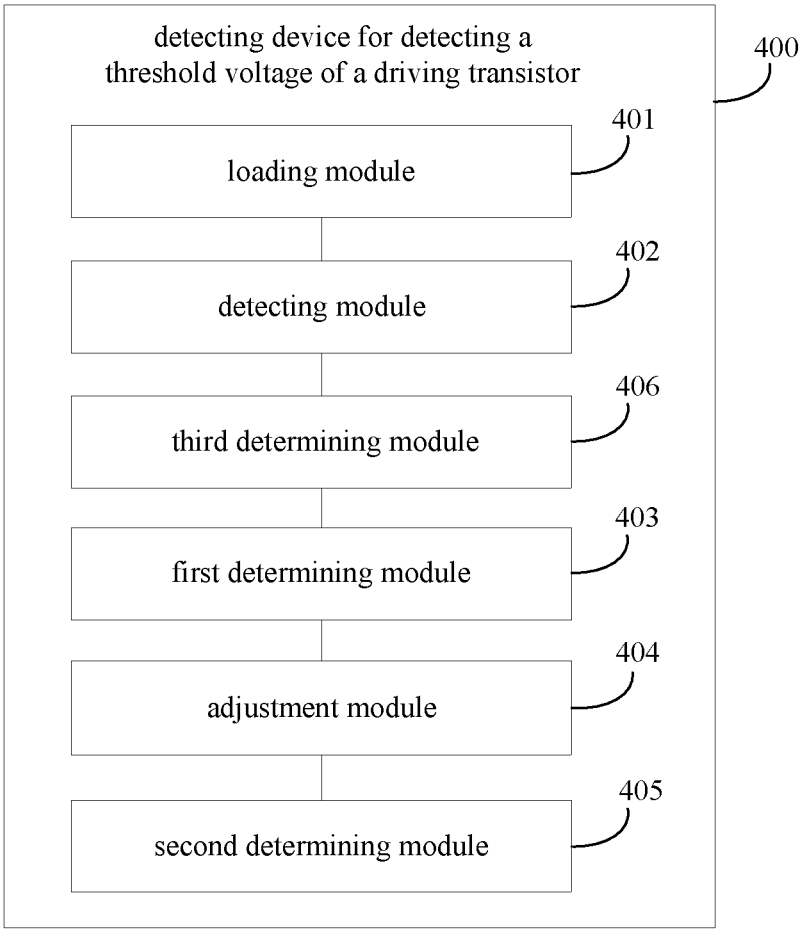

An embodiment of the present disclosure further provides a detecting device for detecting threshold voltages of driving transistors, and the detecting device can be used to detect threshold voltages of respective driving transistors on a display panel. FIG. 4-1 is a structural schematic diagram of a detecting device for detecting threshold voltages of driving transistors provided by an embodiment of the present disclosure; and FIG. 4-2 is another structural schematic diagram of a detecting device for detecting threshold voltages of driving transistors provided by an embodiment of the present disclosure.

For example, as shown in FIG. 4-1, the detecting device 400 for detecting threshold voltages of driving transistors may comprise a loading module 401, a detecting module 402, a first determining module 403, an adjustment module 404 and a second determining module 405.

The loading module 401 is configured to load data signals and reference signals on respective driving transistors in a detection group, and the loading module 401 may comprise the driving module of FIG. 3-3.

The detecting module 402 is configured to detect first-electrode voltages of the respective driving transistors in the detection group when the respective driving transistors in the detection group are in a turn-off state, and the detecting module 402 may comprise the sensing module of FIG. 3-3. For example, the first-electrode voltages may be voltages on first electrodes of the respective driving transistors in the detection group.

The first determining module 403 is configured to determine a target adjustment set in the detection group according to the first-electrode voltages of the respective driving transistors in the detection group and a preset voltage range, and the first determining module 403 may comprise the judgment module of FIG. 3-3.

The adjustment module 404 is configured to adjust at least one of a data signal and a reference signal loaded on a target driving transistor in the target adjustment set, and the adjustment module 404 may comprise the correction module of FIG. 3-3.

The detecting module 402 is further configured to detect a first-electrode target voltage of the target driving transistor when the target driving transistor is in the turn-off state. For example, the first-electrode target voltage may be a voltage on a first electrode of the target driving transistor.

The second determining module 405 is configured to determine a threshold voltage of the target driving transistor according to the first-electrode target voltage of the target driving transistor.

For example, in an example, the detecting module 402 is configured to load the data signals to gate electrodes of the respective driving transistors in the detection group, load the reference signals to first electrodes of the respective driving transistors in the detection group, and load power signals to second electrodes of the respective driving transistors in the detection group.

For example, in an example, the first determining module 403 may be used to:

counting a first number of driving transistors whose first-electrode voltages are not within the preset voltage range in the detection group; and when the first number is greater than a first threshold, determining that the target adjustment set comprises at least a part of the respective driving transistors in the detection group.

For example, the adjustment module 404 may be used to adjust at least one of the data signals and the reference signals loaded on the target driving transistors in the target adjustment set until a quantity of driving transistors whose first-electrode voltages are not within the preset voltage range in the detection group is less than or equal to the first threshold.

For example, in another example, the respective driving transistors in the detection group are arranged in a plurality of rows and a plurality of columns. The first determining module 403 may be also used to:

counting a second number of driving transistors whose first-electrode voltages are not within the preset voltage range in an i-th driving transistor column; and when the second number is greater than a second threshold, determining that the target adjustment set comprises at least a part of driving transistors in the i-th driving transistor column.

For example, the symbol i is a positive integer between 1 and N, and the N is a quantity of columns of the respective driving transistors in the detection group.

For example, the adjustment module 404 may be also used to: adjust at least one of the data signals and the reference signals loaded on the target driving transistors in the target adjustment set until a quantity of driving transistors whose first-electrode voltages of are not within the preset voltage range in the i-th driving transistor column is less than or equal to the second threshold.

For example, the adjustment module 404 may be used to: when a first-electrode voltage of the target driving transistor is greater than an upper limit value of the preset voltage range, reduce the data signal, or increase the reference signal, or simultaneously reduce the data signal and increase the reference signal; and when the first-electrode voltage of the target driving transistor is less than a lower limit value of the preset voltage range, increase the data signal, or reduce the reference signal, or simultaneously increase the data signal and reduce the reference signal. For another example, the adjustment module 404 may be also used to: determine a third number of target driving transistors whose first-electrode voltages are greater than an upper limit value of the preset voltage range; determine a fourth number of target driving transistors whose first-electrode voltages are less than a lower limit value of the preset voltage range; when the third number is greater than the fourth number, reduce the data signal, or increase the reference signal, or simultaneously reduce the data signal and increase the reference signal; and when the third number is less than the fourth number, increase the data signal, or reduce the reference signal, or simultaneously increase the data signal and reduce the reference signal.

For example, the detecting module 402 may comprise analog-to-digital converters. The analog-to-digital converters may be used to: detect the first-electrode voltages on the first electrodes of the respective driving transistors in the detection group when the respective driving transistors are in the turn-off state.

For example, as shown in FIG. 4-2, the detecting device 400 may also comprise a third determining module 406.

For example, the third determining module 406 is configured to: when a first-electrode voltage of a corresponding driving transistor output by a corresponding analog-to-digital converter is a maximum output value of the corresponding analog-to-digital converter, determine that the first-electrode voltage of the corresponding driving transistor is greater than the upper limit value of the preset voltage range.

The third determining module 406 may comprise the sensing data detection module of FIG. 3-3.

The third determining module 406 is further configured to: when the first-electrode voltage of the corresponding driving transistor output by the corresponding analog-to-digital converter is a minimum output value of the corresponding analog-to-digital converter, determine that the first-electrode voltage of the corresponding driving transistor is less than the lower limit value of the preset voltage range.

For example, the detecting device for detecting threshold voltages of driving transistors provided by the embodiments of the present disclosure may further include one or more processors and one or more memories. The processor may process data signals and may include various computing architectures such as a complex instruction set computer (CISC) architecture, a reduced instruction set computer (RISC) architecture or an architecture for implementing a combination of multiple instruction sets. The memory may store instructions and/or data executed by the processor. The instructions and/or data may include codes which are configured to achieve some functions or all the functions of one or more devices in the embodiments of the present disclosure. For instance, the memory includes a dynamic random access memory (DRAM), a static random access memory (SRAM), a flash memory, an optical memory or other memories well known to those skilled in the art.

For example, in some embodiments of the present disclosure, the loading module 401, the first determining module 403, the adjustment module 404 and the second determining module 405 and/or the third determining module 406 include codes and programs stored in the memories; and the processors may execute the codes and the programs to achieve some functions or all the functions of the loading module 401, the first determining module 403, the adjustment module 404 and the second determining module 405 and/or the third determining module 406.

For example, in some embodiments of the present disclosure, the loading module 401, the first determining module 403, the adjustment module 404 and the second determining module 405 and/or the third determining module 406 may be specialized hardware devices, which are configured to achieve some or all the functions of the loading module 401, the first determining module 403, the adjustment module 404 and the second determining module 405 and/or the third determining module 406. For instance, the loading module 401, the first determining module 403, the adjustment module 404 and the second determining module 405 and/or the third determining module 406 may be a circuit board or a combination of a plurality of circuit boards, which are configured to achieve the above functions. In embodiments of the present disclosure, the circuit board or a combination of the plurality of circuit boards may include: (1) one or more processors; (2) one or more non-transitory computer-readable memories connected with the processors; and (3) processor-executable firmware stored in the memories.

For example, in some embodiments of the present disclosure, the detecting module 402 may include codes and programs stored in the memories; and the processors may execute the codes and the programs to achieve some functions or all the functions of the detecting module 402.

In summary, in the detecting device for detecting the threshold voltages of the driving transistors provided by the embodiments of the present disclosure, the detecting module is used to detect first-electrode voltages on first electrodes of the driving transistors when the driving transistors are in a turn-off state, the first determining module is used to determine target driving transistors according to the first-electrode voltages, and then the adjustment module is used to adjust at least one of a data signal and a reference signal applied to each target driving transistor, so that a first-electrode target voltage (namely, an adjusted first-electrode voltage) of the target driving transistor is within a preset voltage range, and the second determining module is used to determine a threshold voltage of each target driving transistor according to the first-electrode target voltage. At least one of the data signal and the reference signal applied to each target driving transistor can be dynamically adjusted according to the detected first-electrode voltage of each target driving transistor, so that a detected threshold voltage of the target driving transistor is closer to or equal to an actual threshold voltage of the target driving transistor, and the accuracy of the detected threshold voltage of the target driving transistor is effectively improved.

Those skilled in the art can understand that all or part of the steps of the above embodiments can be implemented by hardware, can also be implemented by instructing the related hardware through program(s), and the program(s) can be stored in a computer-readable storage medium. The above-mentioned storage medium may be a read only memory, a magnetic disk, an optical disk, or the like.

For the present disclosure, the following statements should be noted:

(1) the accompanying drawings involve only the structure(s) in connection with the embodiment(s) of the present disclosure, and other structure(s) can be referred to in common design(s); and (2) in case of no conflict, the embodiments of the present disclosure and the features in the embodiment(s) can be combined with each other to obtain new embodiment(s).

What have been described above are only specific implementations of the present disclosure, the protection scope of the present disclosure is not limited thereto, and the protection scope of the present disclosure should be based on the protection scope of the claims.

What is claimed is:

1. A detecting method for detecting threshold voltages of driving transistors, comprising:

loading data signals and reference signals on respective driving transistors in a detection group;

when the respective driving transistors in the detection group are in a turn-off state, detecting first-electrode voltages of the respective driving transistors in the detection group;

determining an amount of driving transistors, first-electrode voltages of which are not within a preset voltage range, in the detection group, and determining a target adjustment set in the detection group in a case where the amount of the driving transistors, the first-electrode voltages of which are not within the preset voltage range, is greater than a threshold; and for each target driving transistor in the target adjustment set:

during a detecting process of threshold voltages, adjusting a data signal loaded on the target driving transistor;

when the target driving transistor is in the turn-off state, detecting a first-electrode target voltage of the target driving transistor; and determining a threshold voltage of the target driving transistor according to the first-electrode target voltage of the target driving transistor.

2. The detecting method according to claim 1, wherein the threshold comprises a first threshold, determining an amount of driving transistors, first-electrode voltages of which are not within a preset voltage range, in the detection group, and determining a target adjustment set in the detection group in a case where the amount of the driving transistors, the first-electrode voltages of which are not within the preset voltage range, is greater than a threshold, comprises:

counting a first number of driving transistors whose first-electrode voltages are not within the preset voltage range in the detection group; and when the first number is greater than the first threshold, determining that the target adjustment set comprises at least a part of the respective driving transistors in the detection group.

3. The detecting method according to claim 2, wherein for each target driving transistor in the target adjustment set, during the detecting process of threshold voltages, adjusting the data signal loaded on the target driving transistor, comprises:

during the detecting process of threshold voltages, adjusting data signals loaded on target driving transistors in the target adjustment set until a quantity of driving transistors whose first-electrode voltages are not within the preset voltage range in the detection group is less than or equal to the first threshold.

4. The detecting method according to claim 1, wherein the respective driving transistors in the detection group are arranged in a plurality of rows and a plurality of columns, the threshold comprises a second threshold, and determining an amount of driving transistors, first-electrode voltages of which are not within a preset voltage range, in the detection group, and determining a target adjustment set in the detection group in a case where the amount of the driving transistors, the first-electrode voltages of which are not within the preset voltage range, is greater than a threshold, comprises:

counting a second number of driving transistors whose first-electrode voltages are not within the preset voltage range in an i-th driving transistor column;

when the second number is greater than the second threshold, determining that the target adjustment set comprises at least a part of driving transistors in the i-th driving transistor column; and wherein i is a positive integer between 1 and N, and N is a quantity of columns of the respective driving transistors in the detection group.

5. The detecting method according to claim 4, wherein for each target driving transistor in the target adjustment set, during the detecting process of threshold voltages, adjusting the data signal loaded on the target driving transistor, comprises:

during the detecting process of threshold voltages, adjusting data signals loaded on target driving transistors in the target adjustment set until a quantity of driving transistors whose first-electrode voltages are not within the preset voltage range in the i-th driving transistor column is less than or equal to the second threshold.

6. The detecting method according to claim 1, wherein adjusting the data signal loaded on the target driving transistor, comprises:

when a first-electrode voltage of the target driving transistor is greater than an upper limit value of the preset voltage range, reducing the data signal; and when the first-electrode voltage of the target driving transistor is less than a lower limit value of the preset voltage range, increasing the data signal.

7. The detecting method according to claim 6, wherein when the respective driving transistors in the detection group are in the turn-off state, detecting the first-electrode voltages of the respective driving transistors in the detection group, comprises:

adopting analog-to-digital converters to detect the first-electrode voltages on first electrodes of the respective driving transistors in the detection group when the respective driving transistors are in the turn-off state.

8. The detecting method according to claim 7, further comprising:

when a first-electrode voltage of a corresponding driving transistor output by a corresponding analog-to-digital converter is a maximum output value of the corresponding analog-to-digital converter, determining that the first-electrode voltage of the corresponding driving transistor is greater than the upper limit value of the preset voltage range; and when the first-electrode voltage of the corresponding driving transistor output by the corresponding analog-to-digital converter is a minimum output value of the corresponding analog-to-digital converter, determining that the first-electrode voltage of the corresponding driving transistor is less than the lower limit value of the preset voltage range.

9. The detecting method according to claim 1, wherein adjusting the data signal loaded on the target driving transistor, comprises:

determining a third number of target driving transistors whose first-electrode voltages are greater than an upper limit value of the preset voltage range;

determining a fourth number of target driving transistors whose first-electrode voltages are less than a lower limit value of the preset voltage range;

when the third number is greater than the fourth number, reducing the data signal; and when the third number is less than the fourth number, increasing the data signal.

10. The detecting method according to claim 1, wherein loading the data signals and the reference signals on the respective driving transistors in a detection group comprises:

loading the data signals to gate electrodes of the respective driving transistors in the detection group; and loading the reference signals to first electrodes of the respective driving transistors in the detection group.

11. A detecting device for detecting threshold voltages of driving transistors, comprising:

a loading module, comprising a circuit, said loading module configured to load data signals and reference signals on respective driving transistors in a detection group;

a detecting module, comprising at least one analog to digital converter, configured to detect first-electrode voltages of the respective driving transistors in the detection group when the respective driving transistors in the detection group are in a turn-off state;

a first determining module, comprising a circuit, said determining module configured to determine an amount of driving transistors, first-electrode voltages of which are not within a preset voltage range, in the detection group, and to determine a target adjustment set in the detection group in a case where the amount of the driving transistors, the first-electrode voltages of which are not within the preset voltage range, is greater than a threshold;

an adjustment module, comprising a circuit, the adjustment module configured to for each target driving transistor in the target adjustment set, during a detecting process of threshold voltages, adjust a data signal loaded on the target driving transistor in the target adjustment set;

the detecting module, further configured to detect a first-electrode target voltage of the target driving transistor when the target driving transistor is in the turn-off state; and a second determining module, comprising a circuit the second determining module configured to determine a threshold voltage of the target driving transistor according to the first-electrode target voltage of the target driving transistor.

12. The detecting device according to claim 11, wherein the first determining module is configured to:

counting a first number of driving transistors whose first-electrode voltages are not within the preset voltage range in the detection group; and when the first number is greater than a first threshold, determining that the target adjustment set comprises at least a part of the respective driving transistors in the detection group.

13. The detecting device according to claim 12, wherein the adjustment module is configured to, during the detecting process of threshold voltages, adjust data signals loaded on target driving transistors in the target adjustment set until a quantity of driving transistors whose first-electrode voltages are not within the preset voltage range in the detection group is less than or equal to the first threshold.

14. The detecting device according to claim 11, wherein the respective driving transistors in the detection group are arranged in a plurality of rows and a plurality of columns, and the first determining module is configured to:

counting a second number of driving transistors whose first-electrode voltages are not within the preset voltage range in an i-th driving transistor column;

when the second number is greater than a second threshold, determining that the target adjustment set comprises at least a part of driving transistors in the i-th driving transistor column;

wherein i is a positive integer between 1 and N, and N is a quantity of columns of the respective driving transistors in the detection group.

15. The detecting device according to claim 14, wherein the adjustment module is configured to, during the detecting process of threshold voltages, adjust the data signals loaded on target driving transistors in the target adjustment set until a quantity of driving transistors whose first-electrode voltages are not within the preset voltage range in the i-th driving transistor column is less than or equal to the second threshold.

16. The detecting device according to claim 11, wherein the adjustment module is configured to:

when the first-electrode voltage of the target driving transistor is greater than an upper limit value of the preset voltage range, reduce the data signal; and when the first-electrode voltage of the target driving transistor is less than a lower limit value of the preset voltage range, increase the data signal.

17. The detecting device according to claim 16, wherein the detecting module comprises a plurality of analog-to-digital converters, and the analog-to-digital converters are configured to detect the first-electrode voltages on first electrodes of the respective driving transistors in the detection group when the respective driving transistors are in the turn-off state.

18. The detecting device according to claim 17, further comprising: a third determining module comprising a circuit, the third determining module, configured to:

when a first-electrode voltage of a corresponding driving transistor output by a corresponding analog-to-digital converter is a maximum output value of the corresponding analog-to-digital converter, determine that the first-electrode voltage of the corresponding driving transistor is greater than the upper limit value of the preset voltage range; and when the first-electrode voltage of the corresponding driving transistor output by the corresponding analog-to-digital converter is a minimum output value of the corresponding analog-to-digital converter, determine that the first-electrode voltage of the corresponding driving transistor is less than the lower limit value of the preset voltage range.

19. The detecting device according to claim 11, wherein the adjustment module is configured to:

determine a third number of target driving transistors whose first-electrode voltages are greater than an upper limit value of the preset voltage range;

determine a fourth number of target driving transistors whose first-electrode voltages are less than a lower limit value of the preset voltage range;

when the third number is greater than the fourth number, reduce the data signal; and when the third number is less than the fourth number, increase the data signal.

20. The detecting device according to claim 11, wherein the loading module is configured to:

load the data signals to gate electrodes of the respective driving transistors in the detection group; and load the reference signals to first electrodes of the respective driving transistors in the detection group.

* * * * *